US007392655B2

(12) United States Patent
Inaba et al.

(10) Patent No.: US 7,392,655 B2
(45) Date of Patent: Jul. 1, 2008

(54) VAPOR COMPRESSION REFRIGERATING DEVICE

(75) Inventors: Atsushi Inaba, Kariya (JP); Koichi Ban, Tokai (JP); Yasushi Yamanaka, Inazawa (JP)

(73) Assignee: Denso Corporation, Kariya (JP)

( * ) Notice: Subject to any disclaimer, the term of this patent is extended or adjusted under 35 U.S.C. 154(b) by 289 days.

(21) Appl. No.: 11/325,648

(22) Filed: Jan. 4, 2006

(65) Prior Publication Data

US 2006/0144047 A1 Jul. 6, 2006

(30) Foreign Application Priority Data

Jan. 6, 2005 (JP) ..... 2005-001922

(51) Int. Cl.
*F02G 3/00* (2006.01)
*F01K 1/00* (2006.01)

(52) U.S. Cl. ..... 60/616; 60/614; 60/670

(58) Field of Classification Search ..... 60/614, 60/616, 618, 670
See application file for complete search history.

(56) References Cited

U.S. PATENT DOCUMENTS 6,925,824 B2 * 8/2005 Matsunaga et al. ..... 62/228.4
6,928,820 B2 * 8/2005 Inaba et al. ..... 60/618
2004/0216483 A1 11/2004 Inaba et al.

FOREIGN PATENT DOCUMENTS

JP 2540738 7/1996
JP 2001-301438 10/2001

OTHER PUBLICATIONS

U.S. Appl. No. 11/252,274, filed Oct. 2005, Inaba et al.
U.S. Appl. No. 11/194,370, filed Aug. 2005, Inaba et al.

* cited by examiner

*Primary Examiner*—Hoang M Nguyen
(74) *Attorney, Agent, or Firm*—Harness, Dickey & Pierce, PLC

(57) ABSTRACT

In an automotive vehicle having a heater for a heating operation for a passenger room of the vehicle with use of waste heat of an engine, a vapor compression refrigerating device comprises a refrigerating cycle for a cooling operation for the passenger room. The vapor compression refrigerating device further comprises a heating cycle (a heat pump cycle, or a hot gas cycle) for performing a heating operation to engine cooling water by using the high temperature and high pressure refrigerant from a compressor device, wherein a control means activates the heating cycle at a predetermined time before starting an engine when an outside air temperature is lower than a predetermined value. Accordingly, the engine has been already warmed up before a driver gets into the vehicle.

13 Claims, 7 Drawing Sheets

VAPOR COMPRESSION REFRIGERATING DEVICE

CROSS REFERENCE TO RELATED APPLICATION

This application is based on and incorporates herein by reference Japanese patent application No. 2005-1922 filed on Jan. 6, 2005.

FIELD OF THE INVENTION

The present invention relates to a vapor compression refrigerating device having a heat pump cycle or a hot gas cycle, for which some of components of a refrigerating cycle are commonly used, and in particular relates to the vapor compression refrigerating device to be applied to an automotive air conditioning system.

BACKGROUND OF THE INVENTION

In a conventional automotive air conditioning system, as disclosed in Japanese Patent Publication No. 2001-301438, a heating operation is performed by a heat exchanger for heating (heater core), which is provided in a hot water circuit of an automotive engine and uses engine cooling water (hot water) as a heating source. In this system, a cooling operation is performed by an evaporator (corresponding to a heat exchanger for cooling in the above publication) in a refrigerating cycle, in which a compressor device, a condenser device, a depressurizing device, and an evaporator are connected in a closed circuit.

However, it takes a certain time until the heating operation brings out its heating effect, because the heater core brings out its heating function only after a temperature of the engine cooling water has increased above a predetermined temperature after a start of the engine. For vehicle users, it is strongly desirable that the heating operation is achieved immediately after they get into the vehicle, especially in a cold season such as winter.

SUMMARY OF THE INVENTION

The present invention is made in view of the above problem. It is an object of the present invention to provide a vapor compression refrigerating device, in which a heating operation is performed shortly after a passenger gets into a vehicle, by adding an additional function to a refrigerating cycle which is mainly operated for a cooling operation.

According to a feature of the present invention, a vapor compression refrigerating device is applied for an automotive vehicle having a heater device for heating air in the vehicle by use of waste heat from an engine. The vapor compression refrigerating device comprises a refrigerating cycle having a compressor device driven by an electric motor and for compressing refrigerant to high pressure and high temperature vapor, wherein the refrigerant is circulated through a condenser device, a depressurizing device, and an evaporator, so that a cooling function is brought out at the evaporator. The vapor compression refrigerating device further comprises a heating cycle for performing a heating operation to engine cooling water for the engine by use of the high pressure and high temperature refrigerant from the compressor device. A control means activates the heating cycle before the engine is started by a vehicle passenger, when a temperature at a predetermined position is lower than a predetermined value.

According to the above feature, the heating cycle is formed by use of the compressor device of the refrigerating-cycle, so that the engine cooling water is heated, namely the engine is warmed up, by the heating cycle before the engine is started. Accordingly, a heating operation for the air in the vehicle can be carried out at the heater device by the waste heat from the engine, immediately after a vehicle driver gets into the vehicle and the engine is started.

Furthermore, a warm-up period for the engine can be shortened because the engine side (the engine cooling water) has been heated before the engine operation. A fuel consumption ratio as well as emission control performance can be also improved.

According to another feature of the invention, the heating cycle is formed by a heat pump cycle, which comprises the compressor device, a heating device for heat-exchanging heat between the refrigerant and the engine cooling water, a first depressurizing device for depressurizing the refrigerant flowing out from the heating device, and the condenser device. The condenser device performs a function of absorbing heat from outside air, and the heating device heats the engine cooling water with the high pressure and high temperature refrigerant from the compressor device. In the heat pump cycle, the engine cooling water is heated by such a heat amount, which corresponds to a heat amount absorbed at the condenser device and a heat amount obtained by the work at the compressor device.

According to a further feature of the invention, the heating cycle is formed by a hot gas cycle, which comprises the compressor device, a heating device for heat-exchanging heat between the refrigerant and the engine cooling water, a second depressurizing device for depressurizing the refrigerant flowing out from the heating device, and the condenser device. The heating device heats the engine cooling water with the high pressure and high temperature refrigerant from the compressor device. In the hot gas cycle, the engine cooling water is heated at the heating device, wherein the heat is radiated from the refrigerant by such a heat amount, which corresponds to a heat amount obtained by the work at the compressor device. The above heating operation can be performed even at an extremely low outside air temperature, since the heat absorbing function (as in the heat pump cycle) is not performed at the condenser device in the hot gas cycle.

According to a still further feature of the invention, the vapor compression refrigerating device further comprises a Rankine cycle. The Rankine cycle is formed by a pump for pumping out the refrigerant, the heating device, an expansion device operated by expansion of the refrigerant, and the condenser device. In the Rankine cycle, the refrigerant is heated at the heating device by the engine cooling water, a temperature of which is increased by an engine operation, after the engine has been started by the vehicle passenger, and a driving power is collected at the expansion device which is driven by the expansion of the refrigerant from the heating device.

According to the above feature, the waste heat from the engine can be effectively utilized by collecting the waste heat as the driving power at the expansion device with the operation of the Rankine cycle, in the case that the operation for the refrigerating cycle is not required and the engine cooling water is heated to a sufficiently high temperature by the engine operation.

According to a still further feature of the invention, the compressor device is operated as the expansion device when the refrigerant is supplied into the compressor device from the heating device.

According to the above feature, the compressor device and the expansion device can be constructed as a fluid machine, which is smaller in its size.

According to a still further feature of the invention, the control means starts an activation of the heating cycle before the engine is started by the vehicle passenger, in accordance with a setting time inputted by the vehicle passenger or a time related to the setting time.

According to a still further feature of the invention, the heating cycle is activated when the outside air temperature or the temperature of the engine cooling water is lower than the predetermined value.

According to a still further feature of the invention, the heating cycle is activated when a charge amount of electric power in a battery is higher than a predetermined value, wherein the battery supplies the electric power to the heating cycle.

According to the above feature, the battery (11) is prevented from excessively discharging its electric power during the operation of the heating cycle before the engine operation.

According to a still further feature of the invention, an electric pump is provided in the engine for circulating the engine cooling water through the engine, and the electric pump is operated when the heating cycle is activated.

According to the above feature, the engine cooling water is circulated in a hot water circuit for the engine, so that heat-exchange performance between the refrigerant and the engine cooling water is improved, and thereby the engine cooling water is effectively heated by the refrigerant.

According to a still further feature of the invention, the vapor compression device can be preferably applied for a hybrid vehicle having a driving motor in addition to the engine.

In the hybrid vehicle, an operation ratio of the engine is set at a lower value for a low speed running of the vehicle. An amount of the waste heat from the engine is therefore small. And in particular, the waste heat from the engine is not sufficient for heating the air in the vehicle in the winter. Accordingly, the heating operation by the heating cycle is effective.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
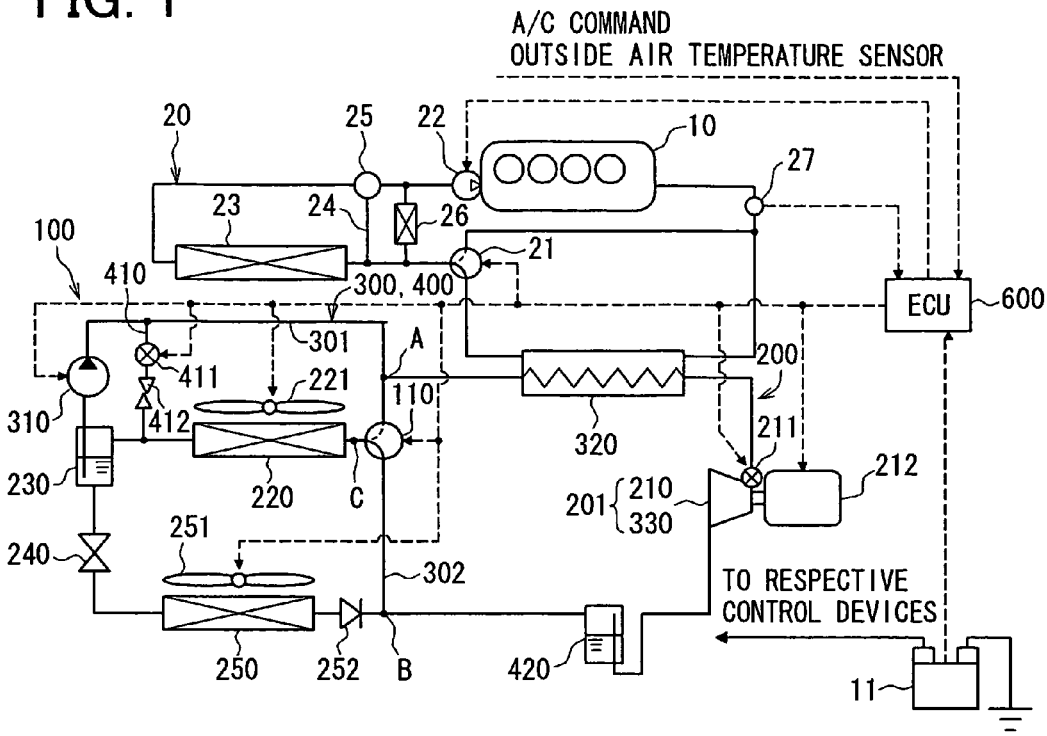
FIG. 1 is a schematic view showing a vapor compression refrigerating device according to a first embodiment of the present invention.

FIG. 1 shows a schematic system structure of a vapor compression refrigerating device 100 according to a first embodiment of the present invention, wherein the refrigerating device 100 is applied to an air conditioning system for a hybrid vehicle having a water cool type engine 10 and a motor for running, which are driving power sources for the vehicle.

As shown in FIG. 1, a Rankine cycle 300 and a heat pump cycle 400 as well as a well known refrigerating cycle 200 are incorporated in the vapor compression refrigerating device 100 (hereafter, simply referred to as the refrigerating device 100).

The refrigerating cycle 200 utilizes low temperature heat and high temperature heat by transferring heat from a low temperature side to a high temperature side, and includes a compressor device 210, a condenser device 220, a gas-liquid separator 230, a depressurizing device 240, and an evaporator 250, which are connected circularly in this order.

The compressor device 210 is a fluid machine for compressing refrigerant into high temperature and high pressure refrigerant, and constitutes an expansion-compressor device 201, which is also operated as an expansion device 330 for the Rankine cycle 300. The compressor device 210 (the expansion device 330) is, for example, constructed as a scroll type fluid machine. A control valve 211 is provided at a high pressure side of the expansion-compressor device 201. The control valve 211 switches the expansion-compressor device 201 either to the compressor device 210 or the expansion device 330. More specifically, the control valve 211 is operated as a discharge valve (a check valve) when the expansion-compressor device 201 is operated as the compressor device 210 (an operation with a forward rotation), whereas the control valve 211 is operated as a valve for opening a refrigerant passage of the high pressure side when the expansion-compressor device 201 is operated as the expansion device 330 (an operation with a reversed rotation). The control valve 211 is controlled by a controller 600, which is described later.

An electric rotating device 212, which has both functions of an electric power generator and an electric motor, is connected with the expansion-compressor device 201 (the compressor device 210, the expansion device 330). The electric rotating device 212 is operated as the electric motor for driving the expansion-compressor device 201 (compressor device 210) in a compression mode, when it is supplied with electric power by a battery (also referred to as a battery charger of the present invention) 11 under a control of the controller 600. In addition, when the expansion-compressor device 201 (expansion device 330) generates, in an expansion mode, driving power from expansion of vaporized refrigerant heated at a heating device 320 described later, the electric rotating device 212 is operated as the electric power generator for generating electric power by using the driving power. The generated electric power is stored in the battery 11 by the controller 600, and the electric power in the battery 11 is supplied to the control valve 211 and to other devices (21, 22, 110, 221, 251, 310, and 411) described later, and further supplied to electric loads, such as head lights and engine auxiliary equipment. An amount of charged power of the battery 11 is outputted to the controller 600.

The condenser device 220 is provided at a discharge side of the compressor device 210 for cooling down and condenses (liquidizes) the high temperature and high pressure refrigerant. A condenser fan 221 blows cooling air (outside air) toward the condenser 220 and is controlled by the controller 600.

The gas-liquid separator 230 is a receiver for separating the refrigerant (which is condensed at the condenser 220) into gas phase refrigerant and liquid phase refrigerant, to discharge the liquid phase refrigerant. The depressurizing device (also referred to as a depressurizing means) 240 is a temperature dependent type expansion valve for depressurizing and expanding the liquid phase refrigerant separated at the gas-liquid separator 230, wherein an opening degree of the expansion valve is controlled so that the refrigerant is depressurized in an isenthalpic manner and that superheated degree of the refrigerant to be sucked into the compressor device 210 is controlled at a predetermined value.

The evaporator 250 is a heat exchanger for performing a heat absorbing operation by evaporating the refrigerant depressurized by the depressurizing device 240, to cool down air outside of a vehicle (the outside air) or air inside of the vehicle (the inside air), which is blown into a passenger room of the vehicle through the evaporator 250 by a fan 251. The fan 251 is controlled by the controller 600. A check valve 252 is provided at a refrigerant outlet side of the evaporator 250, for allowing the refrigerant to flow only from the evaporator 250 to the compressor device 210.

The above compressor device 210, the condenser 220, the gas-liquid separator 230, the depressurizing device 240 and the evaporator 250 form the refrigerating cycle 200, for transferring the heat from the low temperature side to the high temperature side.

The condenser 220 is commonly used in both of the refrigerating cycle 200 and the Rankine cycle 300. A first bypass passage 301 is provided between the gas-liquid separator 230 and a juncture A, which is an intermediate point between the condenser 220 and the expansion-compressor device 201. The first bypass passage 301 bypasses the condenser 220. A second bypass passage 302 is provided between junctures B and C, wherein the juncture B is an intermediate point between the expansion-compressor device 201 and the check valve 252, whereas the juncture C is an intermediate point between the condenser 220 and the juncture A. The Rankine cycle 300 is formed in the following manner.

A liquid pump 310 is provided in the first bypass passage 301 for circulating the liquid phase refrigerant separated in the gas-liquid separator 230. The liquid pump 310 comprises an electrically driven pump, an operation of which is controlled by the controller 600. The heating device 320 is provided between the juncture A and the expansion-compressor device 201.

The heating device 320 is a heat exchanger for heating the refrigerant by heat-exchange between the refrigerant supplied by the liquid pump 310 and engine cooling water (hot water) of a hot water circuit 20 for the engine 10. The heating device 320 heats the cooling water by use of the refrigerant in the case when the heat pump cycle 400 is operated. A three way valve 21 is provided in the hot water circuit for switching from a water circulation mode to a water non-circulation mode, and vice versa, so that the hot water from the engine 10 is controlled to be supplied or not to be supplied to the heating device 320. A switching operation of the three way valve 21 is controlled by the controller 600.

A water pump 22 is an electric pump for circulating the engine cooling water in the hot water circuit 20 and is controlled by the controller 600.

A radiator 23 is a heat exchanger for cooling down the engine cooling water by heat-exchange between the engine cooling water and the outside air. A radiator bypass passage 24 is a bypass passage for allowing the engine cooling water to bypass the radiator 23. A thermostat 25 is a flow control valve for controlling a flow amount of the engine cooling water flowing through the radiator 23 and a flow amount of the engine cooling water flowing through the radiator bypass passage 24. A heater core 26 (also referred to as a heater of the present invention) for the air conditioning system is provided in the hot water circuit 20, wherein the heater core heats the air by use of the engine cooling water as a heating source.

A water temperature sensor 27 for detecting a temperature is provided at an exit side of the engine 10. A cooling water temperature signal (hereafter referred to as a water temperature signal) detected (outputted) by the water temperature sensor 27 is inputted to the controller 600.

An operating cycle switching valve (also referred to as cycle switching means) 110 is provided at a portion (between the junctures A and C) of the second bypass passage 302 connected with the condenser 220. The switching valve 110 is a valve (a three way valve) for switching the operating cycle to one of the refrigerating cycle 200, the Rankine cycle 300 and the heat pump cycle 400, by opening either one of passages to the juncture A and the juncture B. A switching operation of the switching valve 110 is controlled by the controller 600.

The Rankine cycle 300 is formed by the liquid pump 310, the first bypass passage 301, the heating device 320, the expansion device 330, the second bypass passage 302, the condenser 220, and soon, for collecting from the waste heat of the engine 10 the driving power to be generated at the expansion device 330.

The heat pump cycle 400 (also referred to as the heating means of the present invention) is formed by adding a liquid pump bypass passage 410 to the Rankine cycle 300.

The liquid pump bypass passage 410 bypasses the liquid pump 310. An ON-OFF valve 411 for opening or closing the bypass passage 410 and an orifice 412 are provided in the liquid pump bypass passage 410. An opening area of the orifice 412 is fixed at a predetermined value. The orifice 412 may be replaced by any other depressurizing device or a flow restriction, and is referred to as a first depressurizing device. An operation of the ON-OFF valve 411 is controlled by the controller 600. An accumulator 420 is provided between the juncture B and the compressor device 210, for separating the refrigerant in the cycle into the gas phase and the liquid phase refrigerant, to supply the gas phase refrigerant to the compressor device 210. The accumulator 420 may be provided between the switching valve 110 and the juncture B to avoid being a resistance to the flow of the refrigerant in an operation of the refrigerating cycle 200.

The heat pump cycle 400 is formed by the compressor device 210, the heating device 320, the liquid pump bypass passage 410, the orifice 412, the condenser 220, the accumulator 420, and so on. The condenser 220 is operated as a heat exchanger in the heat pump cycle 400, for absorbing the heat from the outside, whereas the heating device 320 is operated as a heat exchanger for heating the engine cooling water by the high pressure and high temperature refrigerant from the compressor device 210.

The controller (also referred to as a control means) 600 receives an A/C command signal generated depending on a preset temperature set by the passenger, an outside air temperature signal outputted from an outside air temperature sensor (not shown), a cooling water temperature signal outputted from the water temperature sensor 27, and a charge amount signal outputted from the battery 11, and so on. The controller 600 controls, based on the received signals, the three way valve 21, the water pump 22, the switching valve 110, the control valve 211, the electric rotating device 212, the fans 221, 251, the liquid pump 310, and the ON-OFF valve 411. The controller 600 memorizes a program for executing a process shown by a control flowchart in FIG. 5, a water temperature determination map shown in FIG. 6, and a charge amount determination map shown in FIG. 7 and controls the heat pump cycle 400 based on this program and these maps, as described later in detail.

Hereafter, an operation and an effect of the refrigerating device 100 controlled by the controller 600 are described with reference to FIGS. 2 to 9.

Figure 2:
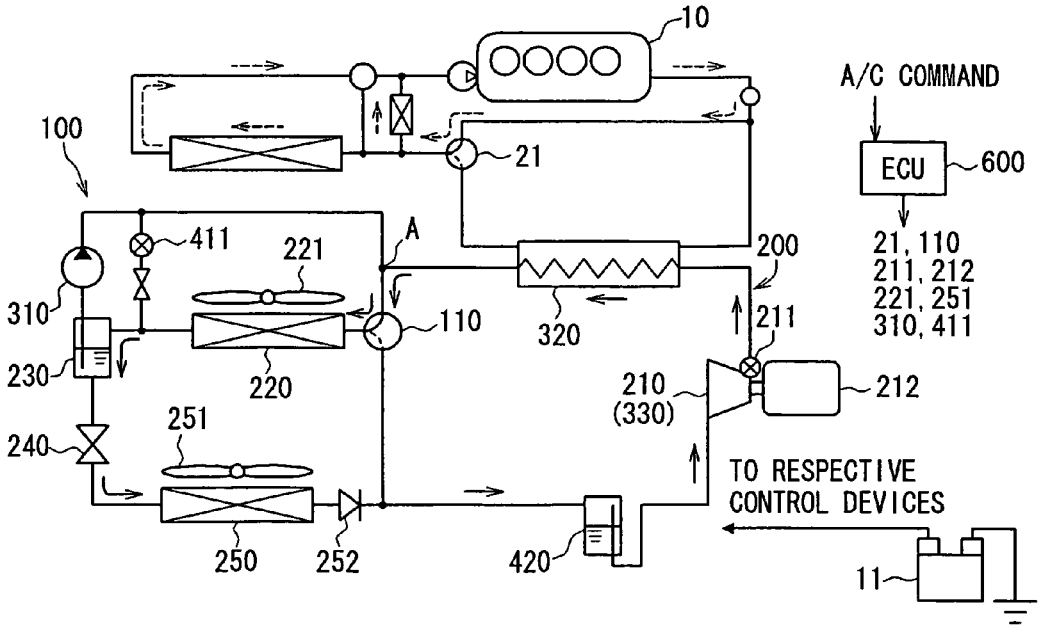
FIG. 2 is a schematic view of the vapor compression refrigerating device showing flows of engine cooling water and refrigerant in a cooling mode.

Cooling Mode: FIG. 2

In the cooling mode, the refrigerating cycle 200 is operated to perform a basic operation of the refrigerating device 100, wherein the refrigerant is cooled down at the condenser 220, and refrigerating performance is brought out at the evaporator 250, as shown in FIG. 2. According to the refrigerating cycle 200 of the embodiment, thermal energy (cooling energy) generated at the evaporator 250 is used for a cooling operation and a dehumidifying operation based on heat absorbing function, whereas thermal energy (heat energy) generated at the condenser 220 is not used for a heating operation of the air conditioning system. The operation of the refrigerating cycle 200 in the heating operation is the same to that in the cooling operation and dehumidifying operation.

More specifically, the switching valve 110 is operated by the controller 600 to communicate the condenser 220 with the juncture A, and the three way valve 21 is operated by the controller 600 so that the engine cooling water is prevented from flowing into the heating device 320, as indicated by arrows of a dotted line. The control valve 211 is switched to be operated as the discharge valve, an operation of the liquid pump 310 is stopped, the ON-OFF valve 411 is closed, and the fans 221 and 251 are operated. Furthermore, the electric rotating device 212 is operated as the electric motor (the rotation in a forward direction), and the expansion-compressor device 201 is operated as the compressor device 210.

The refrigerant is circulated through the compressor device 210, the heating device 320, the switching valve 110, the condenser 220, the gas-liquid separator 230, the depressurizing device 240, the evaporator 250, the check valve 252, and the accumulator 420 as indicated by arrows of a solid line. Since the engine cooling water (hot water) is not circulated through the heating device 320, the heating device 320 is operated simply as a refrigerant passage in this operational mode.

The high pressure and high temperature refrigerant compressed at the compressor device 210 is cooled down at the condenser 220 to be condensed by cooling air (outside air) from the fan 221, depressurized at the depressurizing device 240, and evaporated at the evaporator 250 to absorb the heat from the conditioning air (the outside air or air in the passenger room) supplied from the fan 251. The evaporated gas phase refrigerant is circulated again into the compressor device 210. The conditioning air supplied from the fan 251 is cooled down by latent heat of evaporation of the refrigerant and blown into the passenger room.

Figure 3:
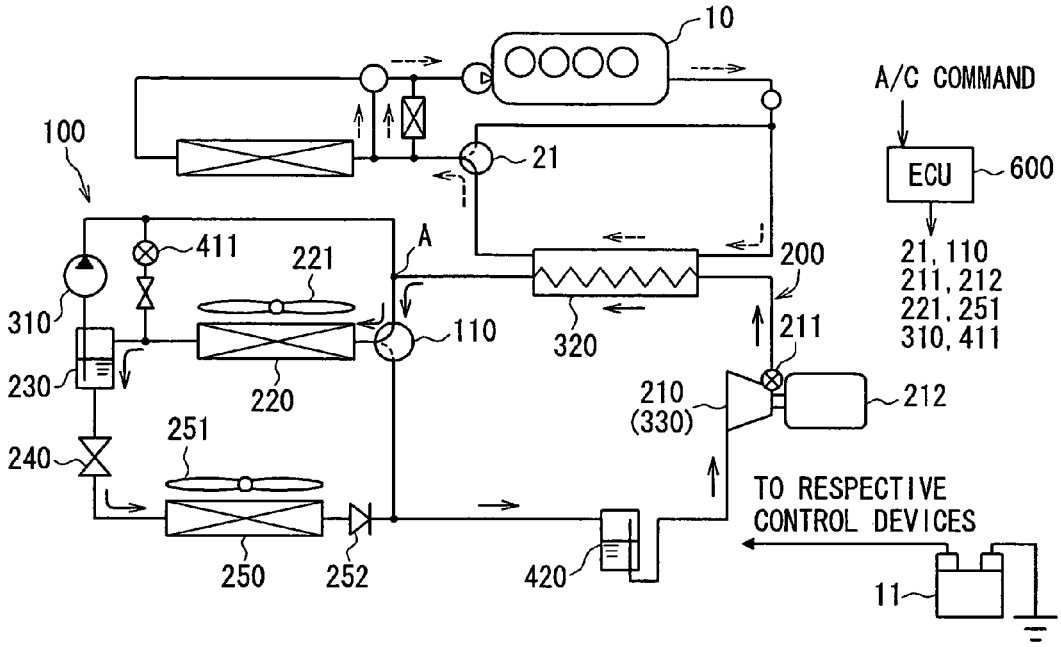
FIG. 3 is a schematic view of the vapor compression refrigerating device showing the flows of the engine cooling water and the refrigerant in a cooling and heating mode.

Cooling & Heating Mode: FIG. 3

This is an operational mode, as shown in FIG. 3, in which the engine cooling water is actively heated, when the engine cooling water is at a low temperature, for example in a period shortly after the engine operation has been started, and when the above described cooling operation by the refrigerating cycle is to be performed.

More specifically, the three way valve 21 is switched by the controller 600 to a position, in which the engine cooling water is allowed to flow into the heating device 320, as indicated by arrows of the dotted line. The other conditions, such as conditions of the switching valve 110, the ON-OFF valve 411 and so on are the same as those in the cooling mode shown in FIG. 2.

In this operational mode, the temperature of the engine cooling water is lower than that of the high pressure and high temperature refrigerant compressed at the compressor device 210, the heat exchange is carried out at the heating device 320 between the engine cooling water and the refrigerant, and thereby the engine cooling water is heated. In other words, the refrigerant is cooled down at the heating device 320. As above, the heating device 320 is operated as the heat exchanger for radiating the heat from the refrigerant to the engine cooling water, in the cooling & heating mode.

Figure 4:
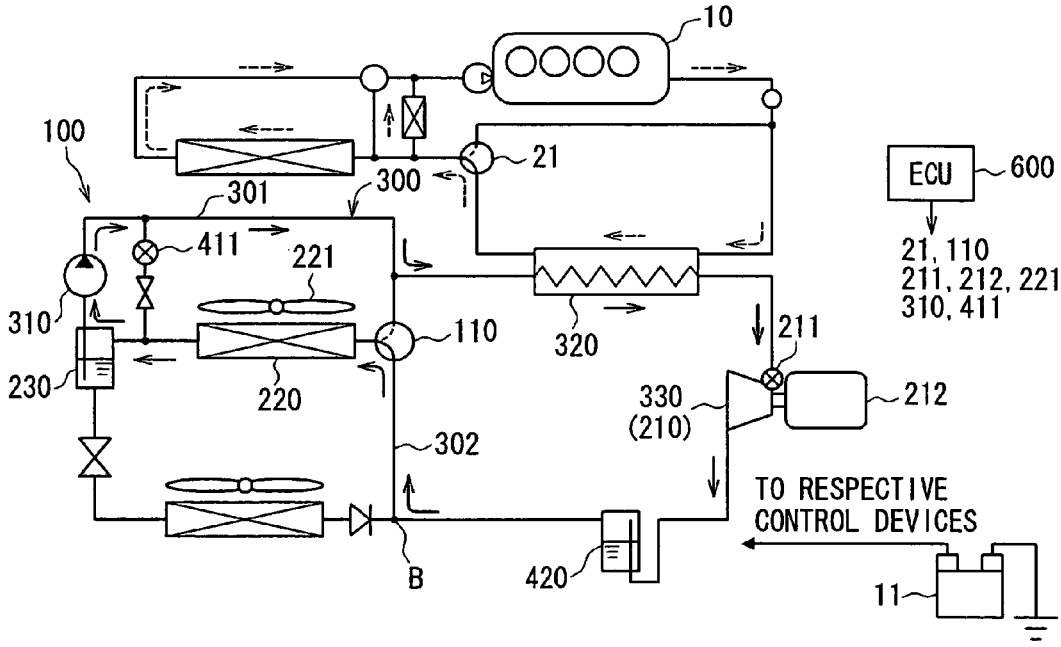
FIG. 4 is a schematic view of the vapor compression refrigerating device showing the flows of the engine cooling water and the refrigerant in a Rankine power generation mode.

Electric Power Generating Mode with Rankine Cycle: FIG. 4

This is an operational mode, in which the Rankine cycle 300 is operated in the case that the controller 600 is not received the A/C command signal (that is, the cooling mode or the cooling & heating mode is unnecessary) and the cooling water temperature increases to reach a predetermined temperature. The Rankine cycle 300 is operated to collect energy from the waste heat of the engine 10, so that the collected energy can be used for other components and devices.

More specifically, as shown in FIG. 4, the switching valve 110 is switched over by the controller 600 to a position at which the condenser 220 is communicated with the juncture B (the second bypass passage 302), the three way valve 21 is switched to the position, in which the engine cooling water is allowed to flow into the heating device 320, as indicated by arrows of the dotted line. The control valve 211 is opened, an operation of the liquid pump 310 is started, the ON-OFF valve 411 is closed, and the fan 221 is operated. Additionally the electric rotating device 212 is operated as the electric power generator.

In this operational mode, the refrigerant is circulated from the gas-liquid separator 230, the first bypass passage 301, the liquid pump 310, the heating device 320, the expansion device 330, the accumulator 420, the second bypass passage 302, the switching valve 110, and the condenser 220, as indicated by arrows of the solid line.

The superheated and vaporized refrigerant heated by the heating device 320 is supplied into the expansion device 330, and expanded in the expansion device 330 in an isentropic manner to decrease its enthalpy. As a result, mechanical energy corresponding to such decreased enthalpy is given by the expansion device 330 to the electric rotating device 212. Namely, the expansion device 330 is rotated by the expansion of the superheated refrigerant, to rotate the electric rotating device 212 (the electric power generator, the rotation of which is in the reversed direction). Electric power generated at the electric rotating device 212 is charged into the battery 11 by the controller 600. The charged power is used for driving the other components and devices.

The refrigerant flowing out of the expansion device 330 is cooled down at the condenser 220 to be condensed, and is accumulated in the gas-liquid separator 230. The liquid phase refrigerant is supplied from the gas-liquid separator 230 to the heating device 320 by the operation of the liquid pump 310. The liquid pump 310 supplies the liquid phase refrigerant into the heating device 320 at such a pressure that the superheated refrigerant heated at the heating device 320 may not flow back toward the gas-liquid separator 230.

Quick Heating Mode (Heating Mode with Heat Pump Cycle): FIGS. 5 to 8

This is an operational mode, in which the engine cooling water is actively heated in advance by operating the heat pump cycle 400 before the engine 10 is started by a vehicle driver in a cold season such as winter.

In this operational mode, a user (the driver) sets the controller 600 at the quick heating mode. For example, the user directly or remotely inputs a boarding time into the controller 600 (which is a time for starting the engine, e.g. 6 o'clock in the morning from Monday to Friday).

Then, the controller 600 specifies, as a preparation time preceding to the start of the engine 10, time (e.g. 5:57 AM) which is a predetermined period (e.g. three minutes) before the boarding time of the day. Then the controller 600 determines at the preparation time whether or not the controller performs the quick heating mode, in accordance with a control flowchart of FIG. 5 based on the determination maps shown in FIGS. 6 and 7, and operates the heat pump cycle 400 when necessary.

More specifically, when the preparation time comes, the controller 600 makes at a step S110 in FIG. 5 a determination whether the outside air temperature detected by the outside air temperature sensor is below a predetermined outside air temperature (e.g. 10 degrees C.). If the determination at the step S110 is affirmative (Y in FIG. 5), the controller 600 makes at a step S120 a determination whether the cooling water temperature detected by the water temperature sensor 27 is below a predetermined water temperature (corresponding to Tw1 in FIG. 6, for example 40 degrees C.). If the determination at the step S120 is affirmative (Y in FIG. 5), the controller 600 makes at a step S130 a determination whether a charge amount of the battery 11 is more than a predetermined charge amount (corresponding to SOC2 in FIG. 7, for example 60%). If the determination at the step S130 is affirmative (Y in FIG. 5), the controller 600 determines at a step S140 to operate the heat pump cycle 400 and controls the same in the following manner.

Figure 8:
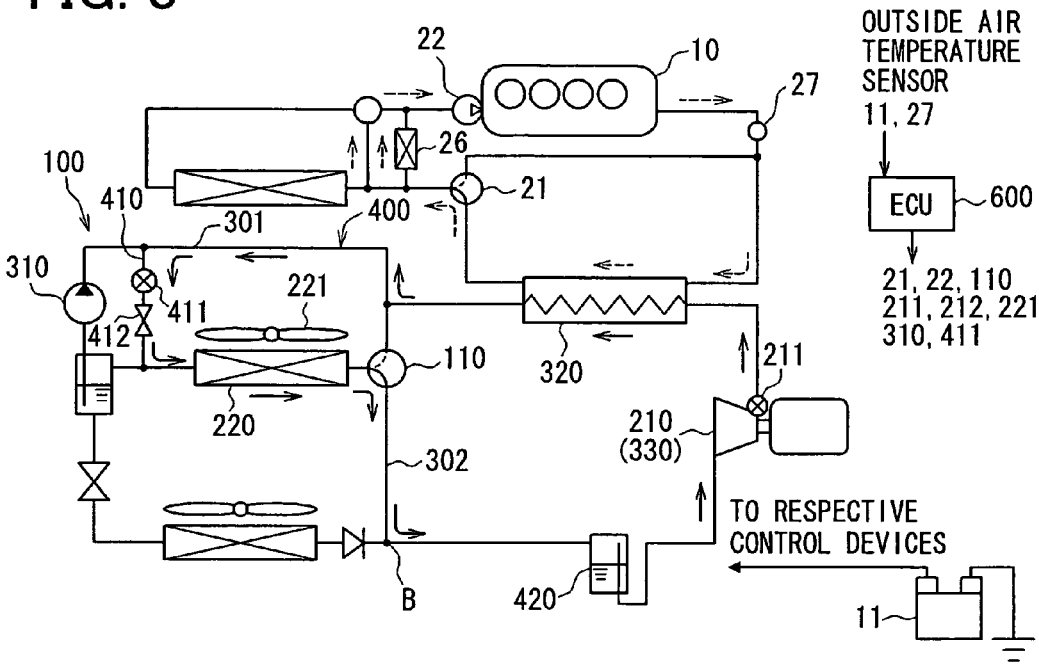
FIG. 8 is a schematic view of the vapor compression refrigerating device showing the flows of the engine cooling water and the refrigerant in the quick heating mode.

As shown in FIG. 8, the switching valve 110 is switched over by the controller 600 to the position at which the condenser 220 is communicated with the juncture B (the second bypass passage 302), and the three way valve 21 is switched to the position, in which the engine cooling water is allowed to flow into the heating device 320, as indicated by arrows of the dotted line. The control valve 211 is switched to a valve mode operating as the discharge valve, the operation of the liquid pump 310 is stopped, the ON-OFF valve 411 is opened, and the fan 221 is operated. Additionally, the electric rotating device 212 is operated as the electric motor (the rotation is in the forward direction), the expansion-compressor device 201 is operated as the compressor device 210, and the water pump 22 is operated.

The refrigerant is circulated, in this operational mode, from the compressor 210, the heating device 320, the first bypass passage 301, the liquid pump bypass passage 410, the ON-OFF valve 411, the orifice 412, the condenser 220, the switching valve 110, the second bypass passage 302, and the accumulator 420, as indicated by arrows of the solid line.

In the same manner as the above cooling & heating mode shown in FIG. 3, the heat exchange is performed at the heating device 320 between the refrigerant and the engine cooling water, so that the engine cooling water is heated. The refrigerant in the heat pump cycle is depressurized by the orifice 412, and evaporated at the condenser 220 by absorbing the heat from the outside air. The gas phase refrigerant evaporated at the condenser 220 is supplied into the accumulator 420, in which the refrigerant is separated into the gas phase and the liquid phase refrigerant, and the gas phase refrigerant is supplied again into the compressor device 210.

In this way, the heating device 320 is operated as a heat radiator for radiating the heat of the refrigerant to the engine cooling water (engine side) in the quick heating mode. The condenser device 220 is operated as a heat exchanger for absorbing the heat of the outside air into the refrigerant. Capability of radiating the heat of the heating device 320 depends on an amount of the heat absorbed at the condenser device 220 and work made by the compressor device 210.

Figure 6:
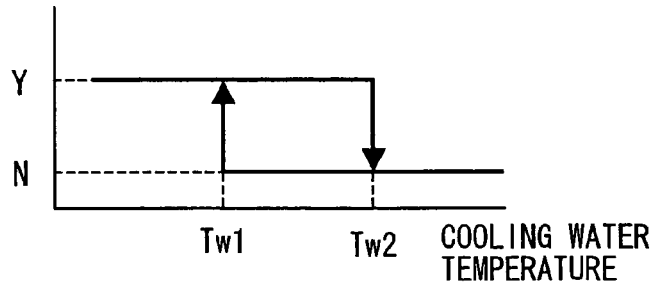
FIG. 6 is a map for determining a cooling water temperature for use in the control of the quick heating mode shown in FIG. 5.
Figure 7:
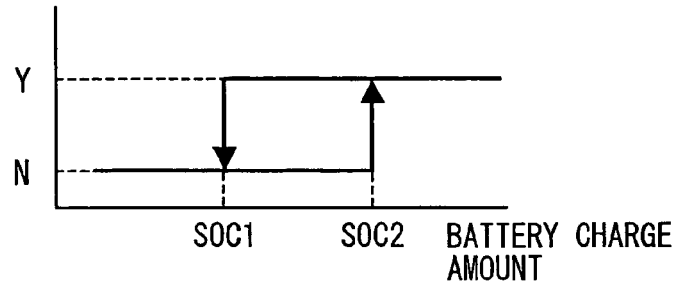
FIG. 7 is a map for determining a charge amount for use in the control of the quick heating mode shown in FIG. 5.

The controller 600 stops at a step S150 the operations of the heat pump cycle 400 and the water pump 22, if any one of the determinations at the steps S110, S120, and S130 is negative (N in FIG. 5), for example, if the cooling water temperature is higher than a temperature Tw2 in FIG. 6, or the charge amount of the battery 11 is below an amount SOC1 in FIG. 7.

As described above, the heat pump cycle 400 is formed as the heating means by commonly using the compressor device 210 and the condenser device 220 of the refrigerating cycle 200. By using the heat pump cycle 400 in the quick heating mode, it is possible to heat the engine cooling water at the preparation time which is before the start of the engine 10. Therefore, the heating operation can be carried out by the heater core 26 which is operated with the engine cooling water as the heating source, even immediately after the passenger (the driver) gets into the vehicle.

In addition, it is possible to shorten a period necessary to warm up the engine 10 after the start thereof, and to thereby improve fuel consumption ratio and emission control performance of the engine 10, because the engine cooling water is heated at a stage before the start of the engine operation.

Figure 9A:
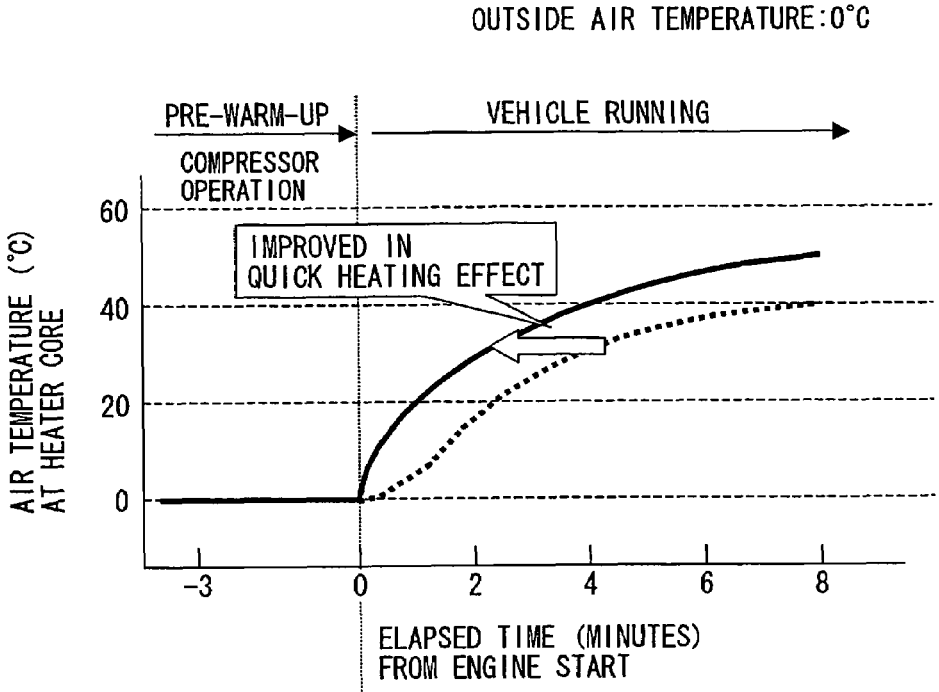
FIGS. 9A and 9B are, respectively, a timing chart showing a blown air temperature and a timing chart showing a cooling water temperature in the quick heating mode.
Figure 9B:
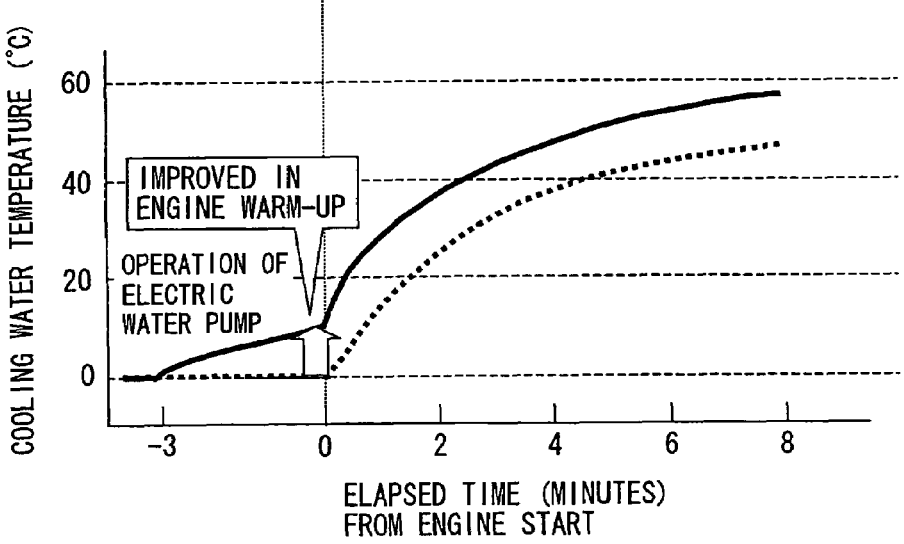

FIGS. 9A and 9B show the above effect quantitatively confirmed for the case that the outside air temperature is 0 degrees C. By operating the heat pump cycle 400 in the quick heating mode, the cooling water temperature (a solid line in FIG. 9B) has increased by 10 degrees C. at a time (zero elapsed time) of the start of the engine 10. In addition, as shown in FIG. 9A, it takes about one minute until an air temperature of the air blown out from the heater core 26 reaches at 20 degrees C. (indicated by a solid line), whereas it takes about 2.5 minutes in the case that the quick heating mode is not operated (as indicated by a dotted line in FIG. 9A).

In addition, since the charge amount of the battery 11 is checked before operating the quick heating mode, it is possible to prevent the battery 11 from excessively discharging its electric power before the start of the engine 10.

In addition, it is possible to form a flow of the engine cooling water at the heating device 320, because the water pump 22 at the engine side is also operated in operating the heat pump cycle 400. Therefore, it is possible to improve heat exchange efficiency between the engine cooling water and the refrigerant, and to effectively heat the engine cooling water.

In addition, the Rankine cycle 300 is provided in which the condenser device 220 of the refrigerating cycle 200 and the heating device 320 of the heat pump cycle 400 are commonly used. Therefore, it is possible to operate the Rankine cycle 300 to collect the driving power and generate the electric power at the expansion device 330, when it is not necessary to operate the refrigerating cycle 200 and the heat pump cycle 400 and it is possible to obtain a sufficient amount of the waste heat from the engine 10. Thus, it is possible to efficiently utilize the waste heat which was conventionally abandoned to the outside air through the radiator 23, and to thereby improve the fuel consumption ratio of the engine 10.

In addition, since the expansion-compressor device 201 is constructed as the fluid machine, which is commonly used as both the compressor device 210 and the expansion device 330, the refrigerating device 100 can be designed to be a compact fluid machine.

The user may input a time, which has a predetermined period before a boarding time for the user getting into the vehicle, and the controller 600 may set the inputted time as the preparation time. The controller 600 may set a time when the user remotely inputs data to the controller 600 as the preparation time.

Second Embodiment

Figure 10:
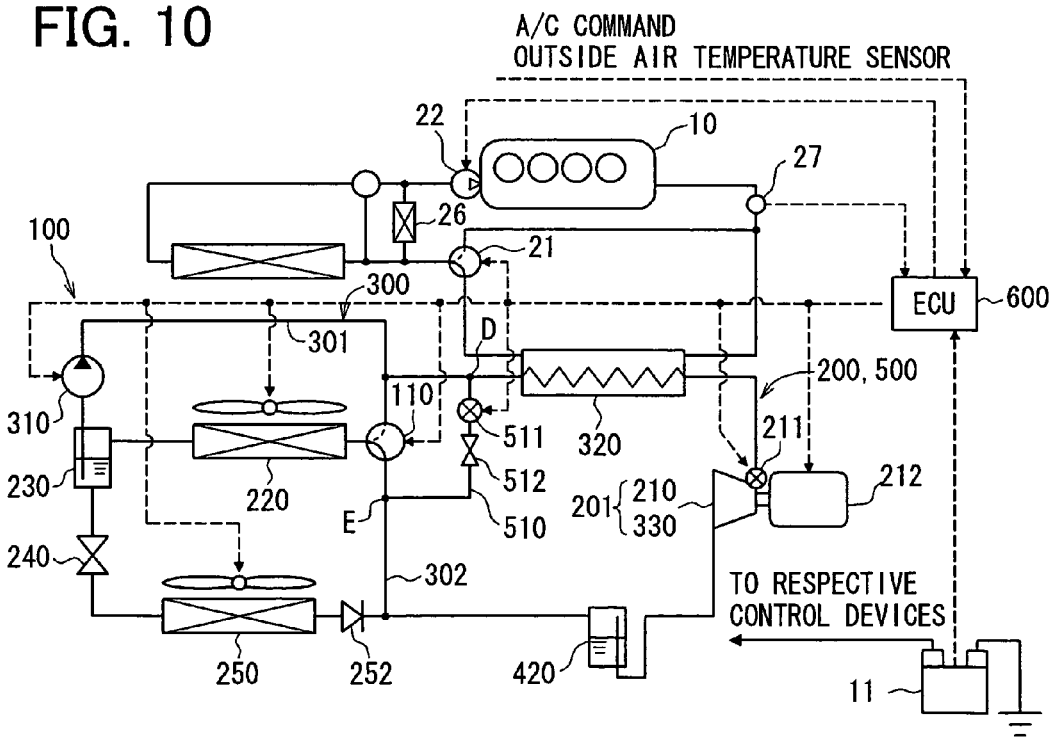
FIG. 10 is a schematic view showing a vapor compression refrigerating device according to a second embodiment of the present invention.

A second embodiment of the present invention is described with reference to FIGS. 10 to 12. The second embodiment is different from the first embodiment in that the heat pump cycle 400 is replaced with a hot gas cycle 500. More specifically, the liquid pump bypass passage 410, the ON-OFF valve 411 and the orifice 412 of the first embodiment are removed, and the hot gas cycle 500 is instead formed by commonly using the compressor device 210 and heating device 320 and by newly adding a switching passage 510.

The switching passage 510 is provided between a juncture D and a juncture E, wherein the juncture D is an intermediate point between the liquid pump 310 and the heating device 320 and the juncture E is an intermediate point between the switching valve 110 and the check valve 252. An ON/OFF valve 511 for opening and closing the switching passage 510 and an orifice 512 with a fixed opening degree are provided in the switching passage 510. The ON/OFF valve 511 is controlled by the controller 600. The orifice 512 may be replaced by any other depressurizing device or a flow restriction, and is referred to as a second depressurizing device.

The hot gas cycle 500 is formed by the compressor device 210, the heating device 320, the switching passage 510, the orifice 512, the accumulator 420, and so on.

In the second embodiment, the controller 600 performs the quick heating mode by operating the hot gas cycle 500. The user sets the quick heating mode (the boarding time) and the controller 600 specifies the preparation time in the same manner as the first embodiment. The controller 600 is operated based on a program which is shown as a flowchart in FIG. 11, which is basically the same as the flowchart in FIG. 5 except for the step S140 replaced with a step S141. More specifically, if the all determinations at steps S110, S120, and S130 are affirmative (Y at the respective steps), the controller 600 starts the operation of the hot gas cycle 500 at the step S141 and controls the same in the following manner.

Figure 12:
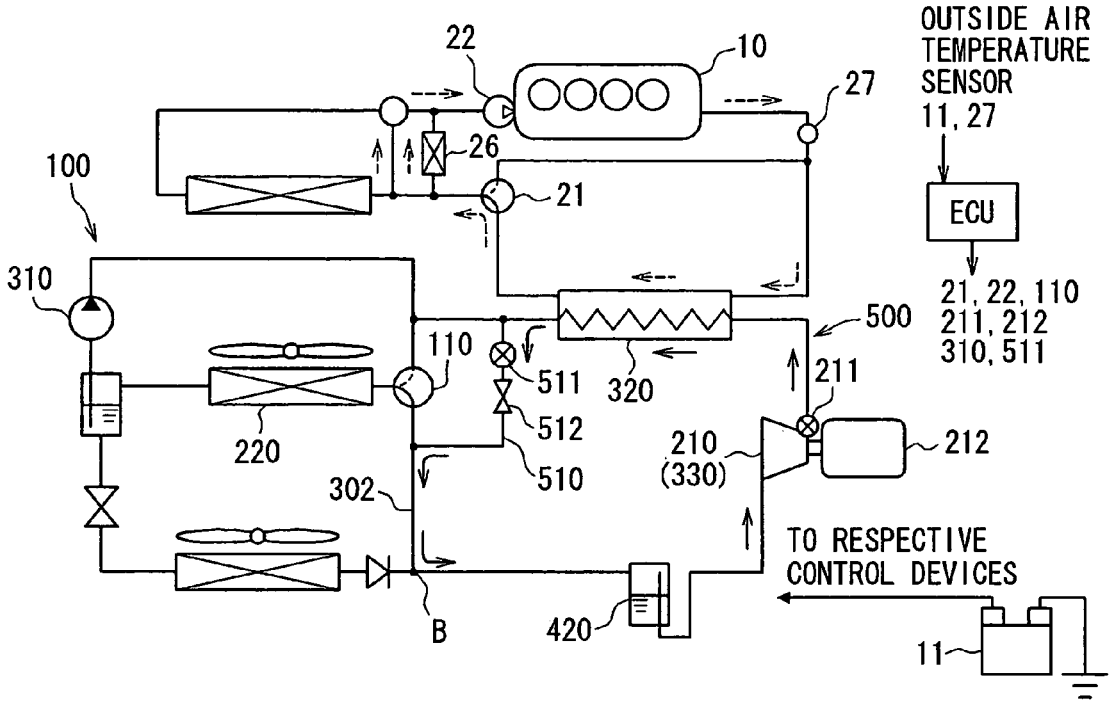
FIG. 12 is a schematic view of the vapor compression refrigerating device according to the second embodiment showing flows of engine cooling water and refrigerant in the quick heating mode.

As shown in FIG. 12, the switching valve 110 is switched over by the controller 600 to the position at which the condenser 220 is communicated with the juncture B (the second bypass passage 302), and the three way valve 21 is switched to the position, in which the engine cooling water is allowed to flow into the heating device 320, as indicated by arrows of the dotted line. The control valve 211 is switched to the valve mode operating as the discharge valve, the operation of the liquid pump 310 is stopped, and the ON-OFF valve 511 is opened. Additionally, the electric rotating device 212 is operated as the electric motor (the rotation is in the forward direction), the expansion-compressor device 201 is operated as the compressor device 210, and the water pump 22 is operated.

The refrigerant is circulated, in this operational mode, from the compressor 210, the heating device 320, the switching passage 510, the ON/OFF valve 511, the orifice 512, the second bypass passage 302, the accumulator 420, and the compressor device 210 as indicated by arrows of the solid line.

In the same manner as the quick heating mode of the first embodiment, the heat exchange is performed at the heating device 320 between the refrigerant and the engine cooling water, so that the engine cooling water is heated. The refrigerant in the hot gas cycle is depressurized by the orifice 512, and separated by the accumulator 420 into the gas phase and the liquid phase refrigerant, and the gas phase refrigerant is supplied again into the compressor device 210.

In the operation of the hot gas cycle 500, the heating device 320 is operated as the heat radiator for radiating the heat to the engine cooling water (the engine side), wherein the heat radiating amount depends on the work made by the compressor device 210.

In the embodiment, it is possible to heat, by using the hot gas cycle 500 in the quick heating mode, the engine cooling water at a stage before the engine 10 is started. Therefore, the heating operation can be carried out by the heater core 26 using the engine cooling water as the heating source, even immediately after the passenger (the driver) gets into the vehicle.

Unlike the heat pump cycle 400 described in the first embodiment, the hot gas cycle 500 does not use the operation of the condenser device 220 for absorbing the heat from the outside air. Therefore, it is possible to heat the engine cooling water even in an extremely low outside air temperature (e.g. below minus 10 degrees C.), by radiating at the heating device 320 the heat corresponding to the work at the compressor device 210.

Other Embodiments

In the first and the second embodiment, it is possible to disuse the Rankine cycle 300 and to operate the device only in the cooling mode and the quick heating mode.

In addition, the controller 600 may use either one of the outside air temperature and the cooling water temperature, for determining whether or not to start the operation of the heat pump cycle 400 or the hot gas cycle 500. The controller 600 may use any other temperature at a different portion as a representative temperature for the device, for determining whether or not to start the operation of the heat pump cycle 400 or the hot gas cycle 500.

Figure 5:
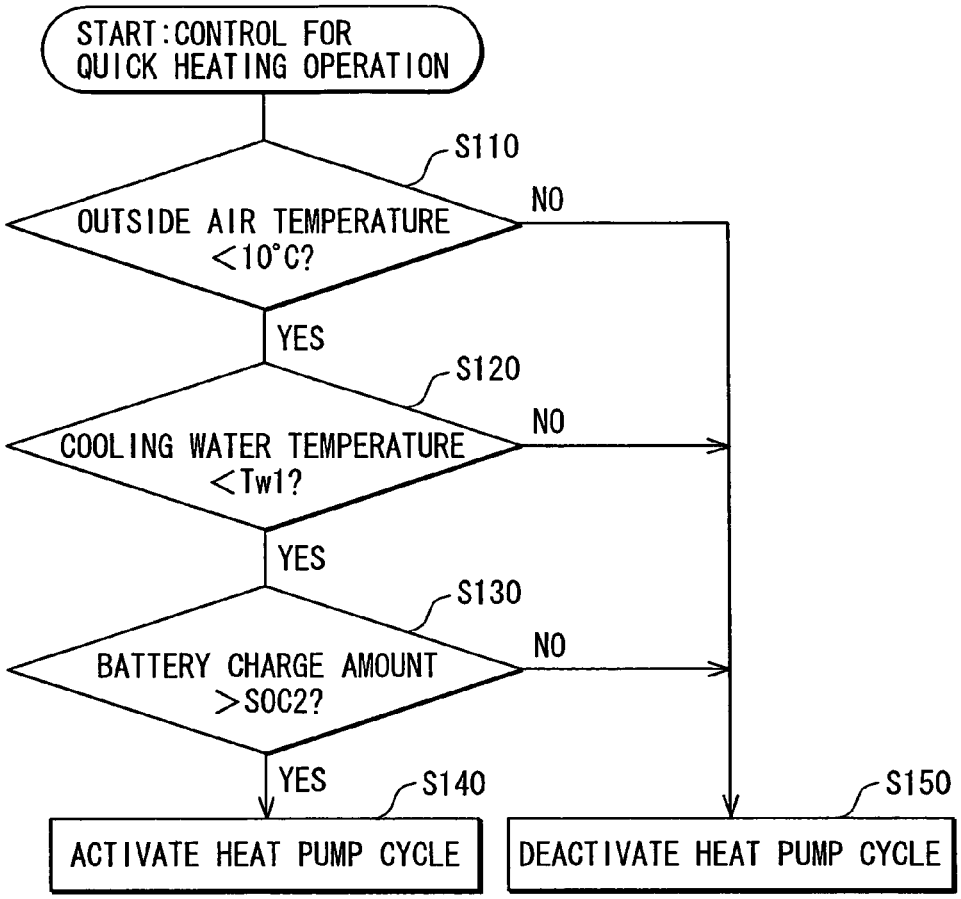
FIG. 5 is a flowchart showing a control of a quick heating mode.
Figure 11:
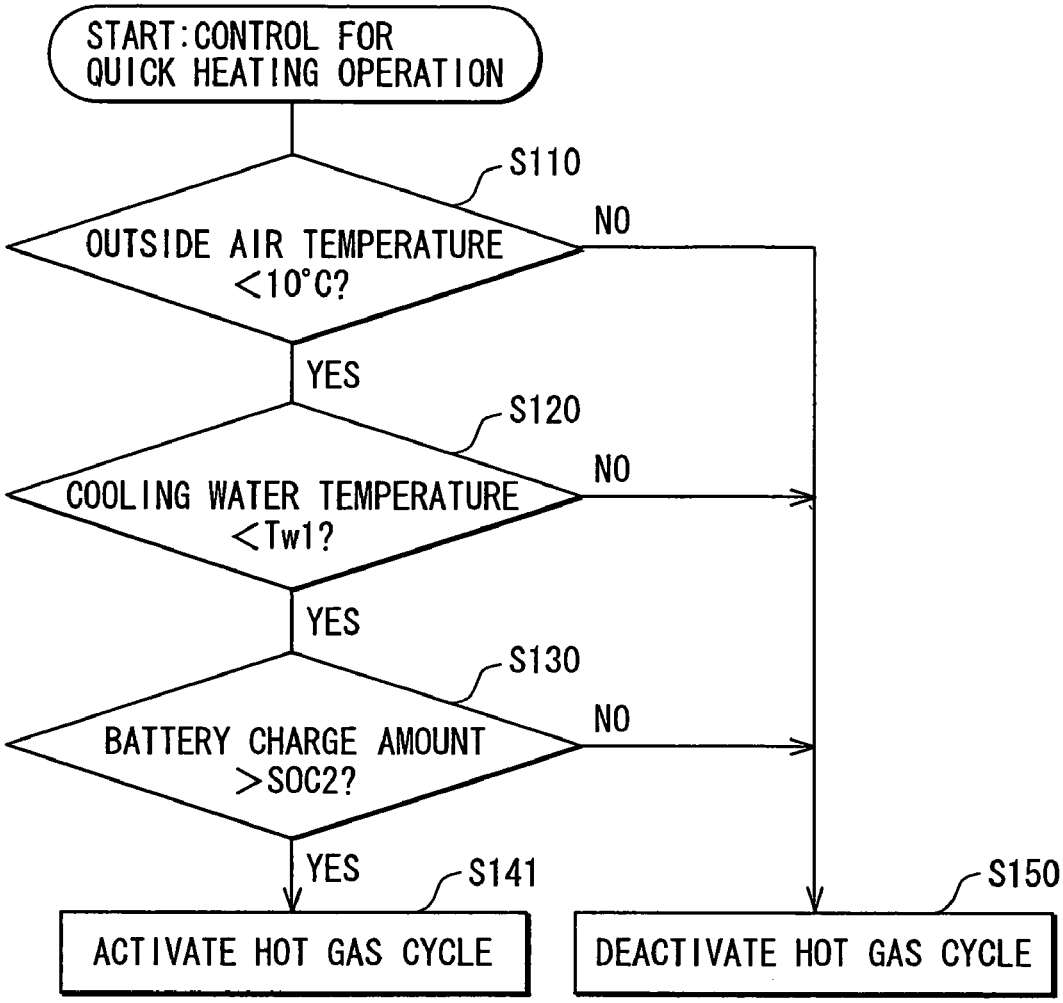
FIG. 11 is a flowchart showing a control of a quick heating mode in the second embodiment.

In addition, the controller 600 may skip the steps S130 of FIG. 5 or FIG. 11 for determining whether the charge amount of the battery 11 is sufficiently high, if the charge amount of the battery 11 is always sufficiently high, independently from the amount of electric power necessary for the operation of the quick heating mode.

In addition, the water pump 22 may be kept inactive, depending on the cooling water temperature during the operation of the quick heating mode.

In addition, the heating device 320 may be provided apart from the refrigerating cycle, namely from a refrigerant passage between the compressor device 210 and the condenser device 220, if the heating of the engine 10 by the heat pump cycle 400 or the hot gas cycle 500 is of significant importance. In such a case, however, the heating of the engine 10 in the cooling & heating mode becomes impossible when the refrigerating cycle 200 is operated.

In addition, the compressor device 210 and expansion device 330 may be provided separately.

In addition, the switching valve 110 may be an ON-OFF valve opening and closing a passage at a juncture A side and a passage at a juncture B side.

In addition, the driving power collected at the expansion device 330 may be stored as kinetic energy by a flywheel or mechanical energy, such as resilience energy by a spring.

In addition, the present invention may be applied to a vehicle having a normal water cooling engine as a power source for running.

What is claimed is:

1. A vapor compression refrigerating device for an automotive vehicle, which has a heater device for heating by use of waste heat from an engine, comprising:

a refrigerating cycle having a compressor device driven by an electric motor and for compressing refrigerant to high pressure and high temperature vapor, wherein the refrigerant is circulated through a condenser device, a depressurizing device, and an evaporator, so that a cooling function is brought out at the evaporator;

a heating cycle for performing a heating operation to engine cooling water for the engine by use of the high pressure and high temperature refrigerant from the compressor device; and a control means for activating the heating cycle before the engine is started by a vehicle passenger, when a temperature at a predetermined position is lower than a predetermined value.

2. The vapor compression refrigerating device according to claim 1, wherein the heating cycle is formed by a heat pump cycle which comprises;

the compressor device, a heating device for heat-exchanging heat between the refrigerant and the engine cooling water, a first depressurizing device for depressurizing the refrigerant flowing out from the heating device, and the condenser device, wherein the condenser device performs a function of absorbing heat from outside air, and the heating device heats the engine cooling water with the high pressure and high temperature refrigerant from the compressor device.

3. The vapor compression refrigerating device according to claim 2, further comprising a Rankine cycle which includes;

a pump for pumping out the refrigerant;

the heating device;

an expansion device operated by expansion of the refrigerant; and the condenser device, wherein the refrigerant is heated at the heating device by the engine cooling water, a temperature of which is increased by an engine operation, after the engine has been started by the vehicle passenger, and a driving power is collected at the expansion device which is driven by the expansion of the refrigerant from the heating device.

4. The vapor compression refrigerating device according to claim 3, wherein the compressor device is operated as the expansion device when the refrigerant is supplied into the compressor device from the heating device.

5. The vapor compression refrigerating device according to claim 1, wherein the heating cycle is formed by a hot gas cycle which comprises;

the compressor device, a heating device for heat-exchanging heat between the refrigerant and the engine cooling water, a second depressurizing device for depressurizing the refrigerant flowing out from the heating device, and the condenser device, wherein the heating device heats the engine cooling water with the high pressure and high temperature refrigerant from the compressor device.

6. The vapor compression refrigerating device according to claim 5, further comprising a Rankine cycle which includes;

a pump for pumping out the refrigerant;

the heating device;

an expansion device operated by expansion of the refrigerant; and the condenser device, wherein the refrigerant is heated at the heating device by the engine cooling water, a temperature of which is increased by an engine operation, after the engine has been started by the vehicle passenger, and a driving power is collected at the expansion device which is driven by the expansion of the refrigerant from the heating device.

7. The vapor compression refrigerating device according to claim 6, wherein the compressor device is operated as the expansion device when the refrigerant is supplied into the compressor device from the heating device.

8. The vapor compression refrigerating device according to claim 1, wherein the control means starts an activation of the heating cycle before the engine is started by the vehicle passenger, in accordance with a setting time inputted by the vehicle passenger or a time related to the setting time.

9. The vapor compression refrigerating device according to claim 1, wherein the temperature at the predetermined position is one of the outside air temperature and the temperature of the engine cooling water.

10. The vapor compression refrigerating device according to claim 1, wherein the control means starts an activation of the heating cycle, when a charge amount of electric power in a battery is higher than a predetermined value, wherein the battery supplies the electric power to the heating cycle.

11. The vapor compression refrigerating device according to claim 1, wherein the engine has an electric pump for circulating the engine cooling water through the engine, and the control means operates the electric pump, when the control means activates the heating cycle.

12. The vapor compression refrigerating device according to claim 1, wherein the automotive vehicle is a hybrid vehicle having an electric driving motor in addition to the engine.

13. In an automotive vehicle, which has a hot water circuit through which engine cooling water is circulated and a heater device provided in the hot water circuit for heating air to be blown into a passenger room of the vehicle by use of waste heat from an engine, a vapor compression refrigerating device comprising:

a refrigerating cycle having a compressor device, a condenser device, and an evaporator, wherein refrigerant is pumped out from the compressor device and circulated through the refrigerating cycle so that a cooling operation for the air to be blown into the passenger room of the vehicle is performed at the evaporator;

a heat pump cycle formed by the compressor device, a heating device, and the condenser device, wherein the high pressure and high temperature refrigerant pumped out from the compressor device is circulated in the heat pump cycle in a quick heating operational mode, so that the engine cooling water is heated at the heating device by the high pressure and high temperature refrigerant; and a control means for activating the heat pump cycle before the engine is started by a vehicle passenger, when a temperature at a predetermined position is lower than a predetermined value.

* * * * *